US009151532B2

(12) United States Patent
Braithwaite et al.

(10) Patent No.: US 9,151,532 B2
(45) Date of Patent: Oct. 6, 2015

(54) RECIRCULATING LIQUID NITROGEN IMMERSION BATH AND METHOD FOR FREEZING A PRODUCT THEREIN

(75) Inventors: David C. Braithwaite, Houston, TX (US); Chris Redlarczyk, Michigan City, IN (US)

(73) Assignee: Air Liquide Industrial U.S. LP, Houston, TX (US)

( * ) Notice: Subject to any disclaimer, the term of this patent is extended or adjusted under 35 U.S.C. 154(b) by 1581 days.

(21) Appl. No.: 12/610,230

(22) Filed: Nov. 23, 2009

(65) Prior Publication Data

US 2011/0120150 A1 May 26, 2011

(51) Int. Cl.
*F25D 3/11* (2006.01)

(52) U.S. Cl.
CPC ..... *F25D 3/11* (2013.01)

(58) Field of Classification Search
CPC ..... F25D 3/11; F25D 13/06
USPC ..... 62/63–64, 125, 374–376, 380
See application file for complete search history.

(56) References Cited

U.S. PATENT DOCUMENTS

| | | | | |
|---|---|---|---|---|
| 3,498,069 | A * | 3/1970 | Waldin | 62/63 |
| 3,609,987 | A * | 10/1971 | Waldin | 62/63 |
| 3,696,631 | A * | 10/1972 | Valdes | 62/282 |
| 3,832,864 | A | 9/1974 | Rasovich | |
| 4,073,158 | A * | 2/1978 | Guiller | 62/266 |
| 4,655,047 | A | 4/1987 | Temple et al. | |
| 4,843,840 | A | 7/1989 | Gibson | |
| 4,982,577 | A | 1/1991 | Milankov et al. | |
| 5,126,156 | A | 6/1992 | Jones | |
| 5,437,237 | A * | 8/1995 | Digre | 110/346 |
| 5,522,227 | A * | 6/1996 | Appolonia | 62/63 |
| 5,522,237 | A | 6/1996 | Wardle | |
| 6,000,229 | A | 12/1999 | Jones et al. | |
| 6,216,470 | B1 | 4/2001 | Kosock et al. | |
| 6,349,549 | B1 | 2/2002 | Angus et al. | |
| 7,475,554 | B2 | 1/2009 | Irvine et al. | |
| 2005/0120726 | A1 | 6/2005 | Kamm | |
| 2007/0281067 | A1 | 12/2007 | Braithwaite | |

FOREIGN PATENT DOCUMENTS

| | | |
|---|---|---|
| EP | 0 275 114 | 7/1988 |
| EP | 0 605 147 | 7/1994 |
| FR | 2 530 323 | 1/1984 |
| WO | WO 01/38804 | 5/2001 |

OTHER PUBLICATIONS

International Application No. PCT/US2010/057585 International Search Report and Written Opinion, mailed Aug. 29, 2011.

* cited by examiner

*Primary Examiner* — Emmanuel Duke
(74) *Attorney, Agent, or Firm* — Christopher J. Cronin

(57) ABSTRACT

A material to be frozen is fed to an immersion bath having a recirculating flow of liquid nitrogen thereinside and at least partially frozen material is withdrawn from the bath downstream of where it is fed.

14 Claims, 11 Drawing Sheets

RECIRCULATING LIQUID NITROGEN IMMERSION BATH AND METHOD FOR FREEZING A PRODUCT THEREIN

CROSS-REFERENCE TO RELATED APPLICATIONS

None.

BACKGROUND

The freezing of discrete portions of food or non-food materials using liquid nitrogen has been practiced on a commercial scale for several years. While a wide variety of cryogenic apparatuses have been used to accomplish the freezing, many of them can be grouped into five typical types of apparatuses: batch freezers, immersion freezers, tunnel freezers, spiral freezers, and pelletizers.

Batch freezers are typically closed cabinets utilizing a combination of fans and liquid nitrogen sprayers to achieve rapid cooling of products on racks. As the name implies, batch freezers are not used for continuous freezing processes, but are often used to complete freezing initiated by a different upstream freezing process.

Immersion freezers utilize a conveyor belt that is loaded with primarily solid product that travels through a bath of liquid nitrogen. Typically, it is used for individually quick frozen (IQF) applications to partially or fully freeze food products. Typically, partially or fully frozen products are directed from the freezer conveyor to another conveyor for further freezing in another cryogenic apparatus.

One special type of immersion freezer disclosed in U.S. Pat. No. 6,349,549 B1 utilizes the same conveyor belt and bath configuration, but instead of loading solid product upstream of the bath, injectors inject a liquid or semi-solid dessert confection pre-mix into the bath from above the bath surface. The resultant solid particles are collected by the conveyor belt as it travels out of the bath and transferred to another conveyor belt.

Another special type of immersion freezer disclosed in U.S. Pat. No. 5,522,237 drops products into an inlet side of an open-ended U-shaped tube filled with liquid nitrogen. A flow of the liquid nitrogen directs the products down and towards the bottom of the outlet side of the tube. An auger screw directs the products up the opposite side and deposits them along with an amount of liquid nitrogen onto a cross-wise traveling conveyor belt. The conveyor belt captures the frozen products while holes in the belt allow liquid nitrogen to drip down and into a downwardly sloping chute that extends to the inlet side of the tube.

Tunnel freezers typically utilize a conveyor belt loaded with product that travels past fans which recirculate cold nitrogen gas from an overhead liquid nitrogen spray header. The cold nitrogen gas is directed to all surfaces of the product. Some of these freezers are adapted to rapidly freeze the top surface of the product through direct contact of the product with the liquid nitrogen spray. Three examples of this type of freezer include the ZIP FREEZE™ 3 available from Air Liquide, the ColdFront™ Ultra Performance Tunnel Freezer available from Praxair, and the Freshline® CQ Tunnel available from Air Products. Some tunnel freezers pass the conveyor belt through a bath of liquid nitrogen upstream of product loading to enable quick freezing of the bottom surface (crusting) of the product. One example of this variation is available from Air Liquide under the name CRUST FLOW® V2. Another example of this variation is available from Linde Industrial Gases under the name Cryoline® SC—Super Contact Tunnel Freezer. The Cryoline® SC passes the conveyor belt over liquid nitrogen-cooled plates for bottom crusting of the product instead of immersing the belt in a liquid nitrogen bath.

Spiral freezers typically utilize a conveyor belt loaded with product that travels past fans which recirculate cold nitrogen gas from an overhead liquid nitrogen spray header. The cold nitrogen gas is directed to all surfaces of the product. In contrast the straight-line path taken by the conveyor belt in tunnel freezers, spiral freezers run the belt in a spiral fashion around a center core.

Some freezers are hybrids of the immersion and tunnel types. In one example, a tunnel freezer conveys the conveyor belt through a liquid nitrogen bath upstream of product loading for achieving rapid bottom freeze-crusting. After loading, the belt is conveyed through a separate liquid nitrogen bath for overall freezing and then underneath a series of fans recirculating cold nitrogen gas from an overhead liquid nitrogen spray header. Such a hybrid is available under the name CRUST FLOW® P2 from Air Liquide. In another example disclosed by U.S. Pat. No. 5,522,227, a turbulent flow of liquid nitrogen is provided along a downwardly sloped trough. Solid food supplied to the trough travels through the turbulent liquid nitrogen flow from the head of the trough and along the trough underneath a liquid nitrogen spray header. After passing underneath the spray header, the food and turbulent flow of liquid nitrogen cascades off the end of the trough as a waterfall onto a perforated conveyor belt. The perforated conveyor belt captures the food items and conveys them for further processing. The cascading waterfall of liquid nitrogen is collected in a sump and pumped back to weir at the head of the trough. Liquid nitrogen cascades over a top of a wall of the weir and into the trough. The height of the wall is set to ensure a drop from the top of the wall down to the trough such that turbulent flow is created in the trough.

Pelletizers typically allow droplets of liquid or semi-solid material to drip or be injected into either a static bath of liquid nitrogen or into a flow of liquid nitrogen in a sluiceway, in either case of which the droplets freeze into pellets. In the case of static baths, the frozen pellets settled at the bottom of the bath is typically conveyed up and out of the bath by means such as a rotating auger and directed to further processing. In the case of a sluiceway, the flow of liquid nitrogen cascades off the end of the sluiceway as a waterfall onto a conveyor belt. The conveyor belt captures the solid pellets while the waterfall of liquid nitrogen is typically collected in a sump.

Pelletization of liquid or semi-solid food can also be achieved by a freezer available from Linde Industrial Gases under the name Cryoline® DE Pellet Shooter. The Cryoline® DE Pellet Shooter conveys the belt through a bath of liquid nitrogen. The belt contains cavities into which liquid or semi-solid food is injected downstream of the bath and thereby frozen. The frozen pellets can then be ejected from the belt onto another belt for further freezing.

While the above immersion and tunnel freezers utilizing conveyor belts have been used with much success in freezing various products, many of these freezers experience difficulty handling a variety of different types of materials to be frozen and/or experience difficulty handling different production rates. Typically, the residence time (the time that the material remains immersed in the bath of liquid nitrogen or remains in a tunnel) is controlled by controlling the belt speed. When a relatively high residence time is necessary, a relatively low belt speed can produce the desired residence time. However, such a speed may lower the production rate below a point which is acceptable. In order to boost the production rate for such high residence time products, the belt loading can be increased but the loading density of the material on the belt quickly reaches a maximum where product-to-product sticking will occur. When the production rate is limited by the belt loading density, the size of the immersion bath can be increased or the length or the tunnel or number of tunnels can be increased. This can quickly increase the capital cost of the cryogenic device.

On the other hand, relatively high belt speeds through the liquid nitrogen bath in the above immersion freezers can result in a significant amount of liquid nitrogen carryover (also called "belt slinging"). The carryover liquid nitrogen can accumulate in the freezer exhaust system or be spilled on the facility floor. This can result in an environment unsafe for personnel, damaged floors, and excessive use of liquid nitrogen. While the belt slinging cannot be completely eliminated, it can be ameliorated by providing a suitable liquid nitrogen "catch" system at the end of the freezer. However, this can still result in an excessive use of liquid nitrogen.

The depth of the liquid nitrogen in the above-described immersion freezers with conveyor belts often must be limited. Raising the level beyond this limit can eliminate the necessary intimate contact between the belt and the product to be frozen. Thus, it has a detrimental effect on consistent product transfer. Because the depth is limited, if a greater degree of freezing is desired, the belt speed can be decreased or the length of the bath can be increased. As discussed in greater detail above, decreasing the belt speed can negatively impact the production rate. Decreasing the length of the bath can quickly increase the capital cost of the cryogenic device.

The above immersion freezers and freezing tunnels utilizing a conveyor belt can often negatively impact the shape of the product. Some products can stick to the belt resulting in a damaged bottom surface. While other products might not stick, contact with the belt can leave a belt-shape impression on the product's bottom surface.

The above immersion freezers utilizing conveyor belts also often exhibit difficulty handling frozen products whose density in the liquid nitrogen causes them to float above the surface of the conveyor belt. As a result, the to-be-frozen and already frozen products remain in a relatively static position that causes product to product sticking as more and more product is introduced by the belt into the bath. This problem can be alleviated to a certain extent by using a conveyor belt with cleats. However, unless the cleats are tall enough to stick out of the top surface of the bath, this is a partial solution at best.

Depending upon the porosity of the conveyor belt, these immersion and tunnel freezers often do not have the ability to freeze liquids or semi-solids. Those freezers having a belt with sufficiently low porosity or freezers of the Cryoline® DE Pellet Shooter kind can pelletize liquids and semi-solids, but the product density per square foot of conveyor belt is limited to the fact that only one layer of products can be frozen on the belt.

While the above-described pelletizers have also been used with much success in pelletizing liquids or semi-solids, they often waste liquid nitrogen in that too much liquid nitrogen boils off in the attempt to freeze the product. One way to decrease the waste of liquid nitrogen is to render the residence time fairly constant. This can be accomplished by having liquid nitrogen flow at a relatively constant rate along a downwardly sloping ramp or sluiceway, where it can flow until it reaches a reservoir or sump. The amount of time taken for the liquid nitrogen to travel the ramp or sluiceway is fairly constant and controllable, depending on the length and slope of the ramp or sluiceway. It is therefore possible to control the residence time of the product in the nitrogen by introducing the product onto the sluiceway at a given point, and removing the frozen product at a given point. However, there are problems associated with the apparatus as described above in that there is a greater amount of liquid nitrogen exposed to the air than necessary, which allows for greater evaporation of the liquid nitrogen. Furthermore, the movement and general agitation of the liquid nitrogen will also cause greater vaporization/evaporation. Since liquid nitrogen is quite expensive, it is undesirable to have any more vaporization/evaporation of liquid nitrogen than is necessary.

The production rate achievable by the above-described pelletizers is limited by the need to clear the space below the injector or dropper so that the droplets or partially frozen pellets do not freeze together.

Because a relatively large amount of the total liquid nitrogen in known pelletization systems is flowing through the sluiceways during operation, a small variation in the flow of liquid nitrogen returning to the reservoir can create a widely varying level of liquid nitrogen in the reservoir. These known pelletizers typically utilize a liquid nitrogen level sensor in order to replenish liquid nitrogen consumed during operation. Because the liquid nitrogen level can widely vary, control of the liquid level can be complicated, inefficient, and not well controlled. This can sometimes lead to an insufficient amount of liquid nitrogen in the reservoir which starves the pump and causes it to lose prime. When prime is lost, the flow of liquid nitrogen down the sluiceways is interrupted, the liquid nitrogen drains off the sluiceways and product jams occur. These product jams can effectively result in several hours of delay and hundreds of pounds of damaged product before normal operation can resume.

As discussed above, the prior art exhibits several disadvantages. Thus, it is an object of the invention to provide solutions to one or more of the following problems:

difficulty handling a wide range of production rates while keeping capital expenses in check, difficulty handling a wide range of production rates without losing intimate contact between the material to be frozen and the conveyor belt, difficulty handling relatively high production rates for pelletization of liquid or semi-solid materials, difficulty pelletizing liquids or semi-solids with high product loading densities for liquids or semi-solids, excessive vaporization of liquid nitrogen from heat sources other than the product to be frozen product jams.

SUMMARY

There is disclosed a method of freezing a product in a recirculating liquid nitrogen immersion bath. It comprises the following steps. A flow of liquid nitrogen is provided along a flow path, the flow path consisting of a horizontal treating section having an upstream end and a downstream end and a return section connecting the downstream end with the upstream end, all vertical portions of the return section totally enclosing the flow of liquid nitrogen. A material to be frozen is fed to the horizontal treating section at a feed point. At least a portion of the fed material is allowed to be frozen by the liquid nitrogen. The at least partially frozen material is withdrawn from the horizontal treating section downstream of the feed point.

There is disclosed another method of freezing a product in a recirculating liquid nitrogen immersion bath. It comprises the following steps. A bath of liquid nitrogen is provided. The liquid nitrogen is caused to flow in a recirculating manner in the following order: along a surface of the bath from a first side to an opposite second side; along a bottom portion of the bath from the opposite second side to the first side; and back to the first side of the surface. A material to be frozen is fed to a portion of the liquid nitrogen flow along the surface. The fed material is allowed to be at least partially frozen by the liquid nitrogen. The at least partially frozen material is withdrawn from the liquid nitrogen.

There is also disclosed an immersion bath for recirculating a flow of liquid nitrogen, comprising: a horizontal trough; a return channel; and a pump. The horizontal trough is adapted to direct the flow of liquid nitrogen from an upstream thereof to a downstream end thereof. The return channel is adapted to direct the flow of liquid nitrogen from the trough downstream end to the trough upstream end. All vertical portions of the return channel are completely enclosed on all vertical sides. The pump is adapted to induce the flow of liquid nitrogen over a top surface of the baffle in a first direction, through the gap between the downstream baffle and container ends, under the bottom surface of the baffle in a second direction opposite that of the first, and through the gap between the upstream baffle and container ends.

There is provided another immersion bath for recirculating a flow of liquid nitrogen, comprising: a container; a horizontal baffle; and a pump. The container has first, second, third and fourth walls extending upwardly from a floor. The first and third walls define upstream and downstream ends of the container, respectively. The container has a height, width, and length. The horizontal baffle is secured between the second and fourth walls, the baffle having upstream and downstream ends and upper and lower surfaces extending therebetween. The baffle has a length shorter than a length of the container and is disposed within the container at a position that leaves a gap between the upstream baffle and container ends, a gap between the downstream baffle and container ends, and a gap between the baffle lower surface and the container floor. The pump is operationally associated with the container and baffle. The pump and the container are adapted to induce the recirculating flow of liquid nitrogen over a top surface of the baffle in a first direction, through the gap between the downstream baffle and container ends, under the lower surface of the baffle in a second direction opposite that of the first, and through the gap between the upstream baffle and container ends.

Any one or more of the method and immersion baths may include one or more of the following aspects:

- the material to be frozen is a liquid or semi-solid and the liquid or semi-solid material is fed to the horizontal treating section by allowing the liquid or semi-solid material to drip into or be injected into the horizontal treating section.
- the material to be frozen is a solid.
- the material to be frozen is fed into the horizontal treating section with a feed conveyor belt at least partially extending over the liquid nitrogen.
- the at least partially frozen material is withdrawn from the horizontal treating section with a porous discharge conveyor belt extending partially into the liquid nitrogen.
- the material to be frozen is a solid and the material to be frozen is fed into the horizontal treating section with a feed conveyor belt at least partially extending over the liquid nitrogen and the feed conveyor belt is run at a speed greater than that of the discharge conveyor belt.
- said step of providing a flow of liquid nitrogen along a flowpath is accomplished with a pump.
- a residence time within the liquid nitrogen of the material to be frozen is controlled by controlling a velocity of the liquid nitrogen flow via the pump.
- a residence time within the liquid nitrogen of the material to be frozen is controlled by controlling a speed of the discharge belt.
- a depth of the liquid nitrogen in the horizontal treating section is greater than a major dimension of the material to be frozen.
- a flow rate of the liquid nitrogen is increased when the rate at which the material to be frozen is fed to the horizontal treating section is increased.
- a flow rate of the liquid nitrogen is decreased when the rate at which the material to be frozen is fed to the horizontal treating section is decreased.
- the material to be frozen is a food item.
- the method or immersion bath further comprises a material feeder operationally associated with the container, the material feeder being adapted to feed liquid, semi-solid, or solid material to be frozen into the flow of liquid nitrogen at a feed point above the baffle upper surface.
- the material feeder is a drip tray.
- the material feeder is an injector.
- the material feeder is a porous conveyor feed belt.
- the method or immersion bath further comprises a porous conveyor discharge belt operationally associated with the container and extending downwardly into the gap between the downstream container and baffle ends.
- the container first wall has a an inner surface that is configured as a semi-cylinder surface curving toward the container upstream end and is adapted to redirect the liquid nitrogen flowing in the second direction under the baffle lower surface back to the first direction over the baffle upper surface.
- the container third wall has a an inner surface that is configured as a semi-cylinder surface curving toward the container downstream end and is adapted to redirect the liquid nitrogen flowing in the first direction over the baffle upper surface back to the second direction under the baffle lower surface.
- the pump has a discharge, the pump is at a position below the baffle lower surface adjacent the baffle upstream end, and the pump is oriented such that the pump discharge aims the flow of liquid nitrogen toward a lower portion of the first wall inner surface.
- the method or immersion bath further comprises a porous discharge conveyor belt operationally associated with the container extending downwardly into the gap between the downstream container and baffle ends to a point below and adjacent the baffle downstream end, wherein the pump has an inlet on an upper surface thereof and a discharge on a peripheral surface thereof, the pump being disposed at a position below the baffle lower surface adjacent the baffle downstream end, the pump being oriented such that the flow of liquid nitrogen downstream of the the cleated porous discharge conveyor belt is sucked into the pump inlet and discharged in the second direction underneath the baffle lower surface

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

The term "pump" is intended to mean an apparatus or machine for raising, driving, exhausting, or compressing fluids or gases, including by means of a piston, plunger, or set of rotating vanes, and which specifically includes but is not limited to impellers.

The invention provides for a method and system for freezing materials that overcomes the disadvantages of the prior art. In a broadest sense, the invention is directed to an immersion bath and method of use in which a material to be frozen is fed to an immersion bath having a recirculating flow of liquid nitrogen therein wherein at least partially frozen material is withdrawn from the bath at a point downstream of where it is fed. More particularly, the material is fed to the bath and a flow of liquid nitrogen directs the wholly or partially frozen material towards a porous conveyor discharge belt where it is captured. The flow of liquid nitrogen passing through the discharge belt may be recirculated back to the feed point by any number of a wide variety of configurations. In one aspect, all vertical portions of the flow path in between the discharge belt and the feed point totally enclose the flow of liquid nitrogen. In another aspect, the liquid nitrogen flows at the surface in one direction towards the discharge belt but flows in the opposite direction at a bottom portion of the immersion bath and then back up to the surface and the feed point. In this aspect, the opposite flows of liquid nitrogen can be separated by one another with use of a baffle therebetween. The phrase "feed point" is not to be limited to a discrete point, but rather also includes a region over which the material is fed to the immersion bath.

Materials suitable for whole or partial freezing by the invention include food items and non-food items. Food items include liquid foods, semi-solid foods (such as liquefied ice cream), and solid foods. Non-food items include liquid chemical compositions and suspensions, mixtures or slurries of biomaterials (such as microbiological ferments).

Figure 1A:
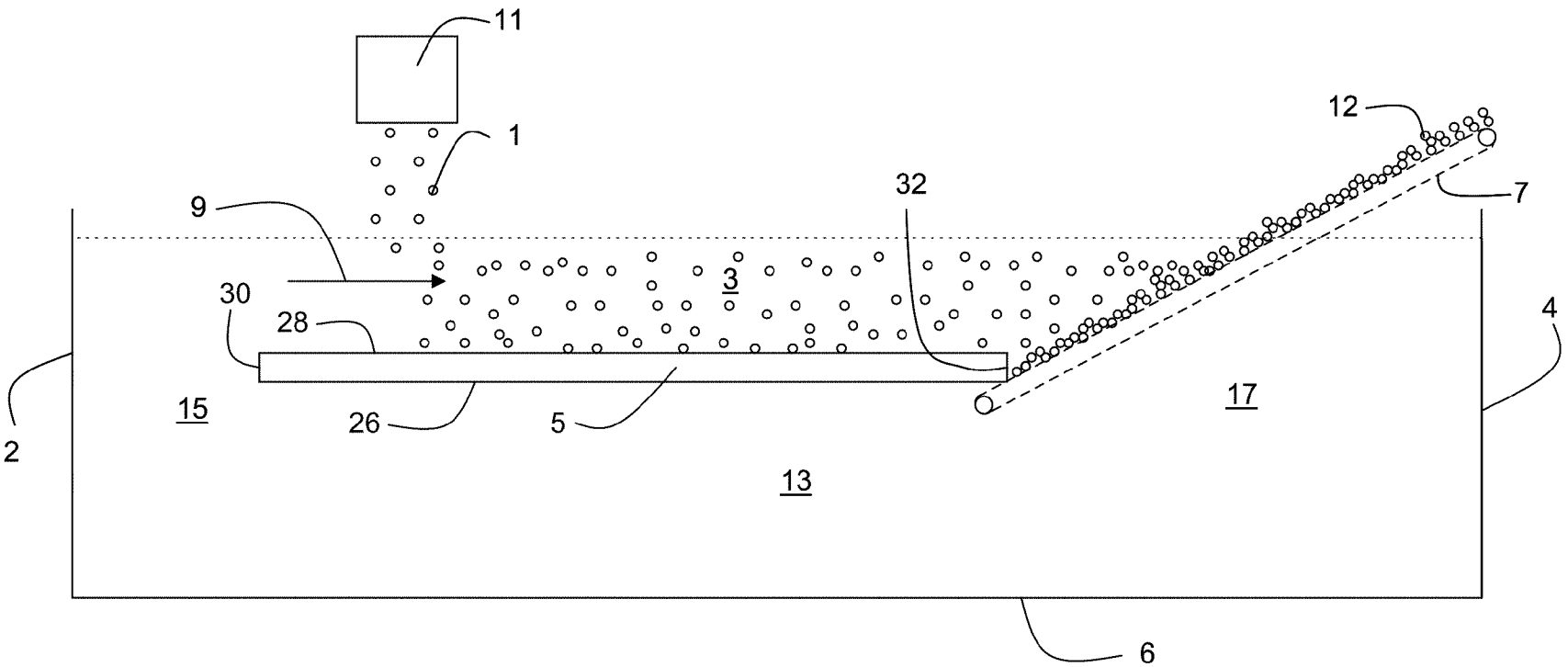
FIG. 1A is an elevation view schematic with parts broken away of an embodiment of the invention illustrating pelletization.
Figure 1B:
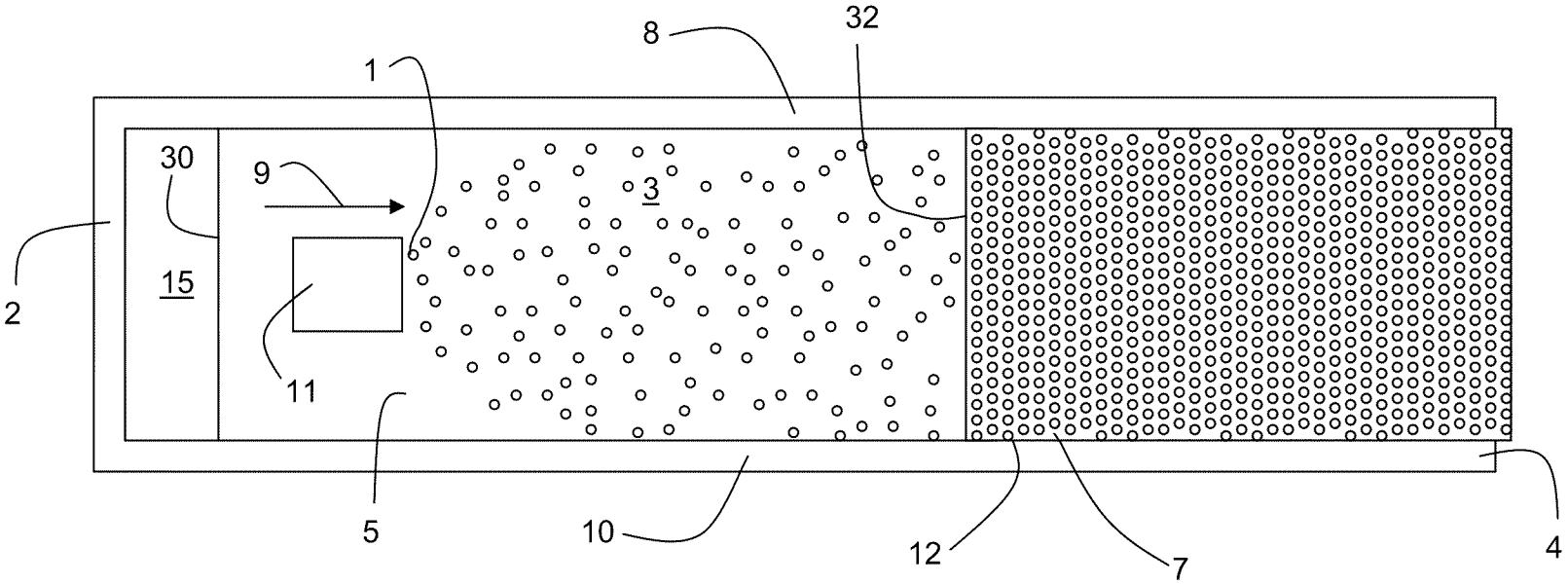
FIG. 1B is a plan view schematic of the embodiment of FIG. 1A.

As best illustrated in FIGS. 1A and 1B, one embodiment of an immersion bath according to the invention includes a recirculating flow of liquid nitrogen in a container along a flow path that includes a horizontal treating section 3 and a return channel. In FIG. 1A, wall 10 is broken away to depict the inside of the immersion bath. The liquid nitrogen flows in a first direction 9 through the horizontal treating section 3 above an upper surface 28 of a baffle 5 from an upstream end 30 of the baffle 5 to a downstream end of the baffle 5. The flow continues through a gap 17 in between a downstream end 32 of a baffle 5 and a downstream end 4 of a container. The flow then continues through a gap 13 between a lower surface 26 of the baffle 5 and a floor 6 of the container. The flow completes a circuit by continuing through a gap 15 in between an upstream end 30 of a baffle 5 and an upstream end 2 of a container and back to the horizontal treating section 3.

While FIGS. 1A, 1B illustrates a return channel including a vertical section through gap 17, a horizontal section through gap 13 adjacent the lower surface 26, and another vertical section through gap 15, it should be noted that the return channel need not have any particular configuration except that all vertical portions of the return channel should totally enclose the flow. A totally enclosed flow in a vertical portions means that, when the liquid nitrogen either flows up or flows down, the peripheral portions of the flow are not open to ambient. This may be contrasted with known pelletizers all of which include a flow of liquid nitrogen that cascades as a waterfall from a sluiceway, through the open air, and into a reservoir. The use of such a cascading waterfall that flows into a reservoir mostly destroys the momentum of the liquid nitrogen flow. This destroyed momentum is converted to useless turbulence in the reservoir.

A material metering device 11 causes a liquid or semi-solid material to fall as droplets 1 into the flow of liquid nitrogen in the horizontal treating section 3. The device 11 can comprise a drip tray where by the liquid or semi-solid is allowed to drip down by gravity through a plurality of holes. Alternatively, the device 11 can comprise a mechanically-actuated injector, an example of which is disclosed by U.S. Published Patent Application No. 20070281067 A1. The material wholly or partially freezes into pellets 12 as it travels with the liquid nitrogen flow towards a porous conveyor discharge belt 7. The discharge belt 7 captures the pellets 12 while allowing the liquid nitrogen to flow through and into gap 17. In order to avoid an excessive amount of liquid nitrogen collecting outside the immersion bath, liquid nitrogen remaining on the surface of the pellets 12 or on the discharge belt 7 as it emerges from the liquid nitrogen is allowed to drip through the discharge belt 7 and into gap 17. Depending upon whether the product has a configuration (such as spherical) that tends to cause rolling when it encounters the discharge belt 7, the porous conveyor discharge belt 7 may be cleated to produce positive traction allowing the pellets 12 to be collected with high loading densities.

While FIGS. 1A, 1B illustrate the discharge belt 7 terminating above the downstream end 4 of the container, it is understood that the discharge belt 7 may continue in the upward angular direction illustrated or it may be urged with a roller to travel in another direction (e.g., horizontal). The pellets 12 may be removed from the discharge belt 7 in a known fashion for transfer to another conveyor belt or to a processing or packaging device, etc.

The immersion bath includes a pump for inducing the liquid nitrogen flow. While it may be disposed inline anywhere in the liquid nitrogen flow path, it is ideally disposed somewhere downstream of the discharge belt 7 and upstream of the material metering device 11. By avoiding contact between the moving parts of the pump and the droplets 1 or pellets 12, fragmentation of the pellets 12 is inhibited.

Figure 2A:
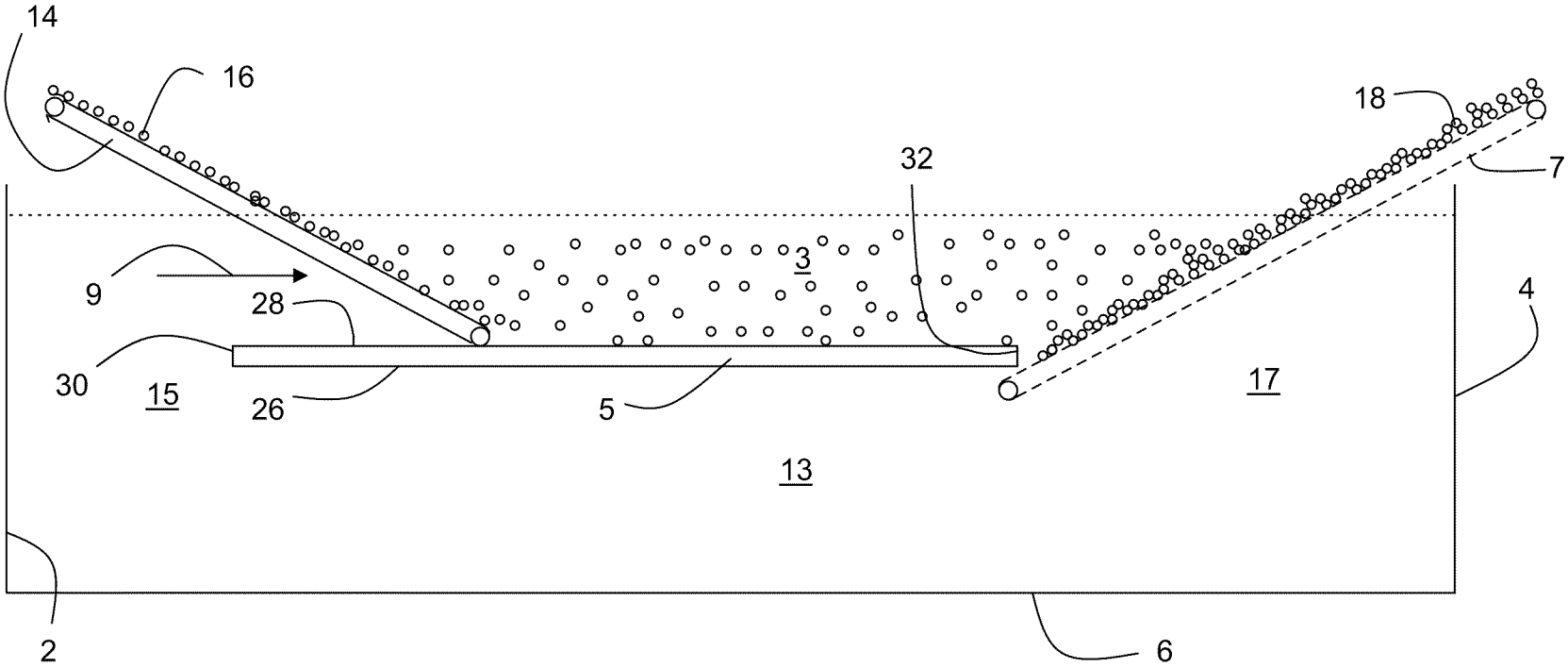
FIG. 2A is an elevation view schematic with parts broken away of another embodiment of the invention illustrating freezing of solid items.
Figure 2B:
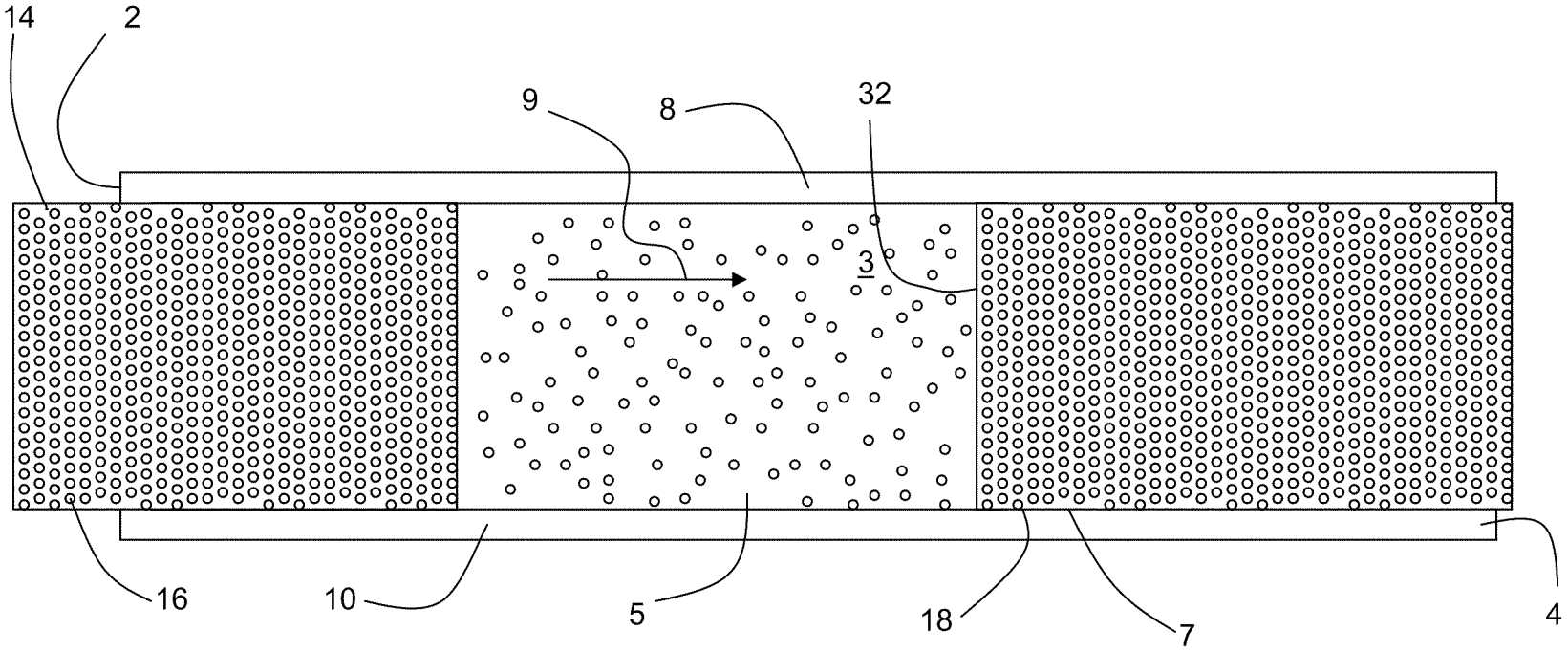
FIG. 2B is a plan view schematic of the embodiment of FIG. 2A.

As best shown in FIGS. 2A and 2B, an immersion bath according to another embodiment is similar to the one illustrated in FIGS. 1A and 1B except that, instead of a metering device 11 to allow droplets of a liquid or semi-solid material to fall into the liquid nitrogen flow, a conveyor feed belt 14 feeds solid items 16 into the liquid nitrogen. While FIGS. 2A and 2B show a conveyor feed belt 14 that extends into and travels through the liquid nitrogen, it may instead extend only to a point over the surface of the liquid nitrogen. In this alternative case, the solid items 16 fall off the edge of the conveyor feed belt 14 as it reverses direction at the terminal roller. Through appropriate adjustment of the height of the conveyor feed belt 14 above the liquid nitrogen, the solid items 16 gently fall into the liquid nitrogen flow. The wholly or partially frozen items 18 are collected by the porous conveyor discharge belt 7 while the liquid nitrogen flows through and into the gap 17.

Figure 3A:
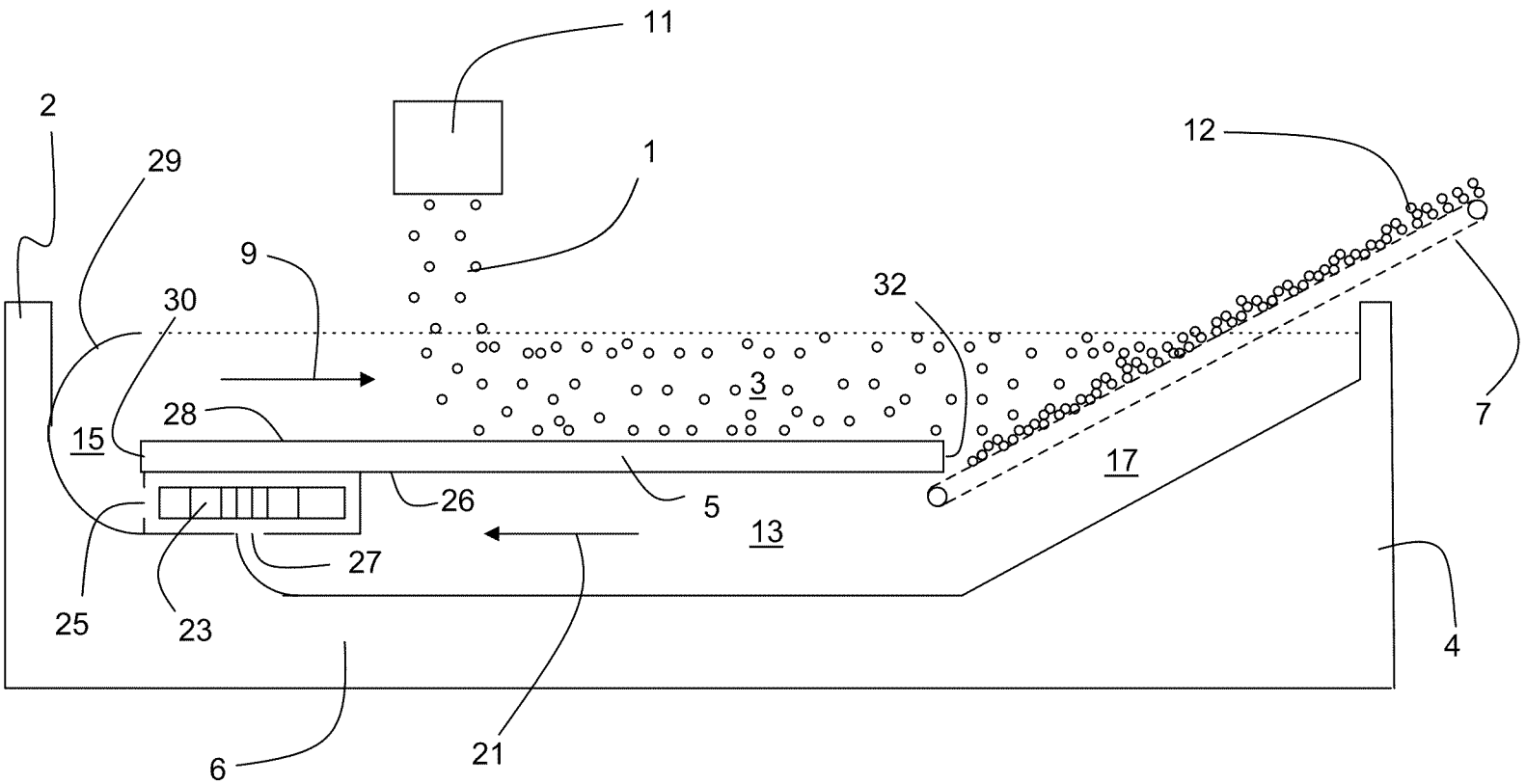
FIG. 3A is an elevation view schematic with parts broken away of an embodiment of the invention illustrating pelletization and the position of the pump.
Figure 3B:
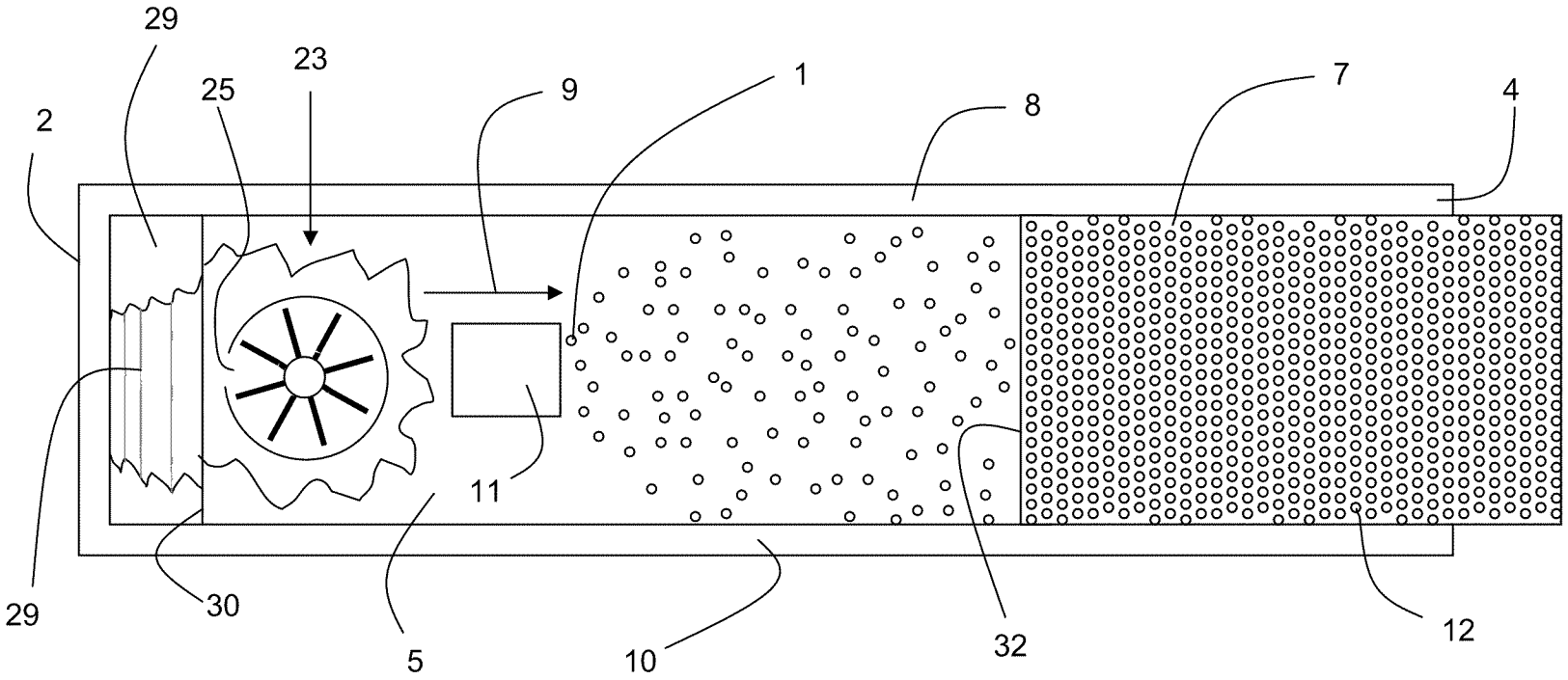
FIG. 3B is a plan view schematic with parts broken away of the embodiment of FIG. 3A.

As best illustrated in FIGS. 3A and 3B, an immersion bath according to another embodiment is similar to that of FIGS. 1A and 1B with two notable differences. First, a pump 23 is disposed underneath the lower surface 26 adjacent to upstream end 30. It is oriented such that the liquid nitrogen flows in a second direction 21 (opposite that of the first direction 9) towards a pump inlet 27 and is discharged by the pump 23 through a pump outlet 25 towards a lower portion of the gap 15. Second, the inner surface of the upstream end 2 of the container is configured as a semi-cylindrical surface 29 in order to redirect the liquid nitrogen flowing out of the discharge 25 and up and around back to the first direction 9 in the horizontal treating section 3. Use of such a surface 29 decreases the amount of flow momentum lost due to turbulence. Alternatively or additionally, a semi-cylindrical surface may also be used in the same fashion as the inner surface of the downstream end wall 4. In such an alternative or additional arrangement, the discharge end of the other pump is oriented such that the liquid nitrogen is discharged from the discharge end in the second direction 21 through the gap 13. The inlet of the other pump could be on the top or bottom surface of the pump in such an alternative or additional arrangement.

FIG. 3B illustrates a plan view of the immersion bath of FIG. 3A. Portions of the baffle 5 are broken away for the purpose of illustrating the position and operation of the pump 23 which in this case is an impeller. Liquid nitrogen underneath the pump is sucked into the pump inlet 27. Centrifugal force causes the liquid nitrogen to be flung towards peripheral portions of the impeller housing and out the pump outlet 25. Some of the upper curved portion of the semi-cylindrical surface 29 is also broken away to show the lower curved portion adjacent the pump outlet 25.

Figure 4:
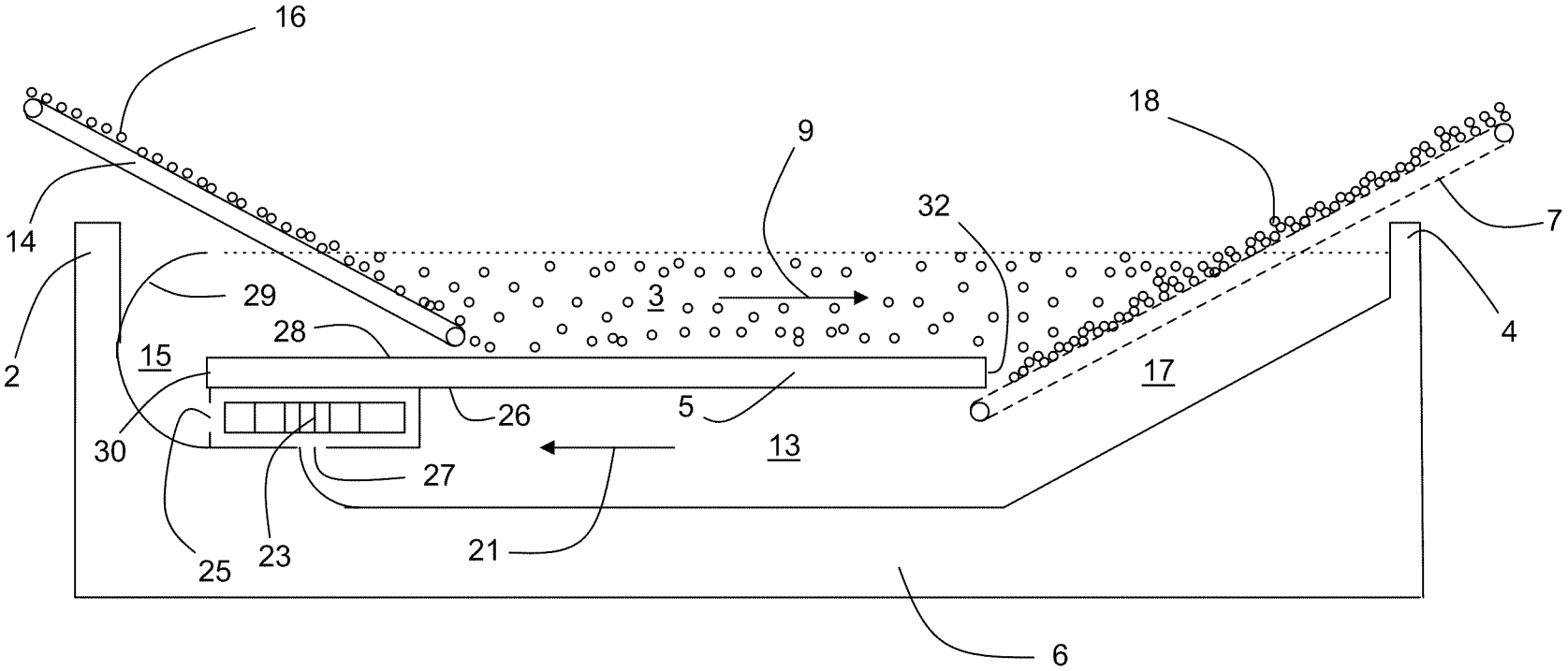
FIG. 4 is an elevation view schematic with parts broken away of an embodiment of the invention illustrating freezing of solid items and the position of the pump.

As best shown in FIG. 4, an immersion bath according to another embodiment is similar to the one illustrated in FIGS. 2A and 2B except that, instead of a metering device 11 to allow droplets of a liquid or semi-solid material to fall into the liquid nitrogen flow, a conveyor feed belt 14 feeds solid items 16 into the liquid nitrogen. While FIG. 4 shows a conveyor feed belt 14 that extends into and travels through the liquid nitrogen, it may instead extend only to a point over the surface of the liquid nitrogen. In this alternative case, the solid items 16 fall off the edge of the conveyor feed belt 14 as it reverses direction at the terminal roller. Through appropriate adjustment of the height of the conveyor feed belt 14 above the liquid nitrogen, the solid items 16 gently fall into the liquid nitrogen flow. The wholly or partially frozen items 18 are collected by the porous conveyor discharge belt 7 while the liquid nitrogen flows through and into the gap 17.

Figure 5:
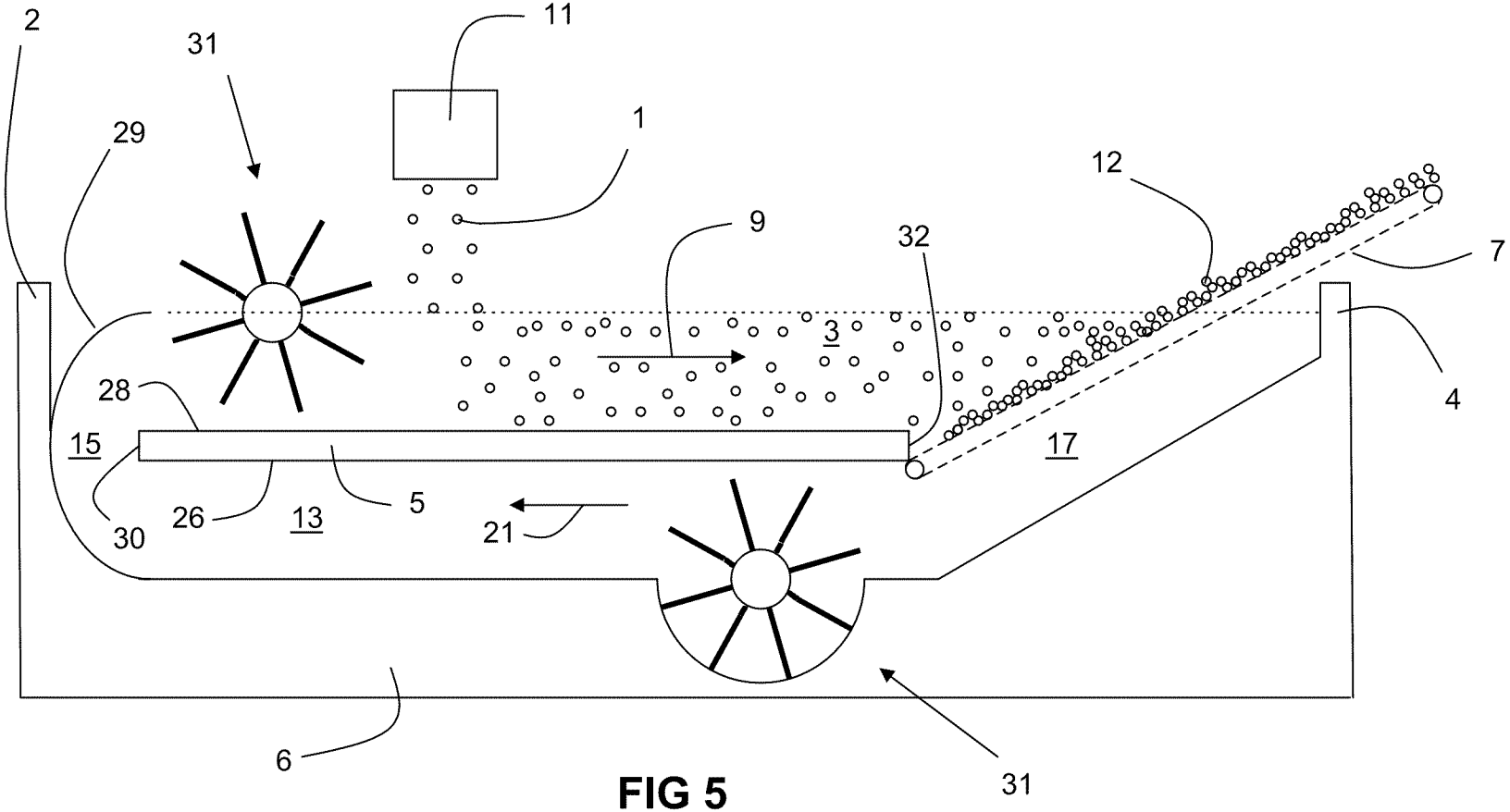
FIG. 5 is an elevation view schematic with parts broken away of a variation of the embodiment of FIGS. 3A and 3B.

As best illustrated in FIG. 5, an immersion bath according to another embodiment is similar to that of FIGS. 1A and 1B with one notable difference. Instead of a pump 23 disposed underneath lower surface 26 adjacent upstream end 30, two paddle wheel-type pumps 31 are disposed in the liquid nitrogen flow with one in the horizontal treating section 3 upstream of metering device 11 and the other in gap 13 underneath the baffle adjacent to gap 17. The inner surface of the upstream end 2 of the container is configured as a semi-cylindrical surface 29 in order to redirect the liquid nitrogen flowing out of the discharge 25 and up and around back to the first direction 9 in the horizontal treating section 3. Use of such a surface 29 decreases the amount of flow momentum lost due to turbulence.

Figure 6:
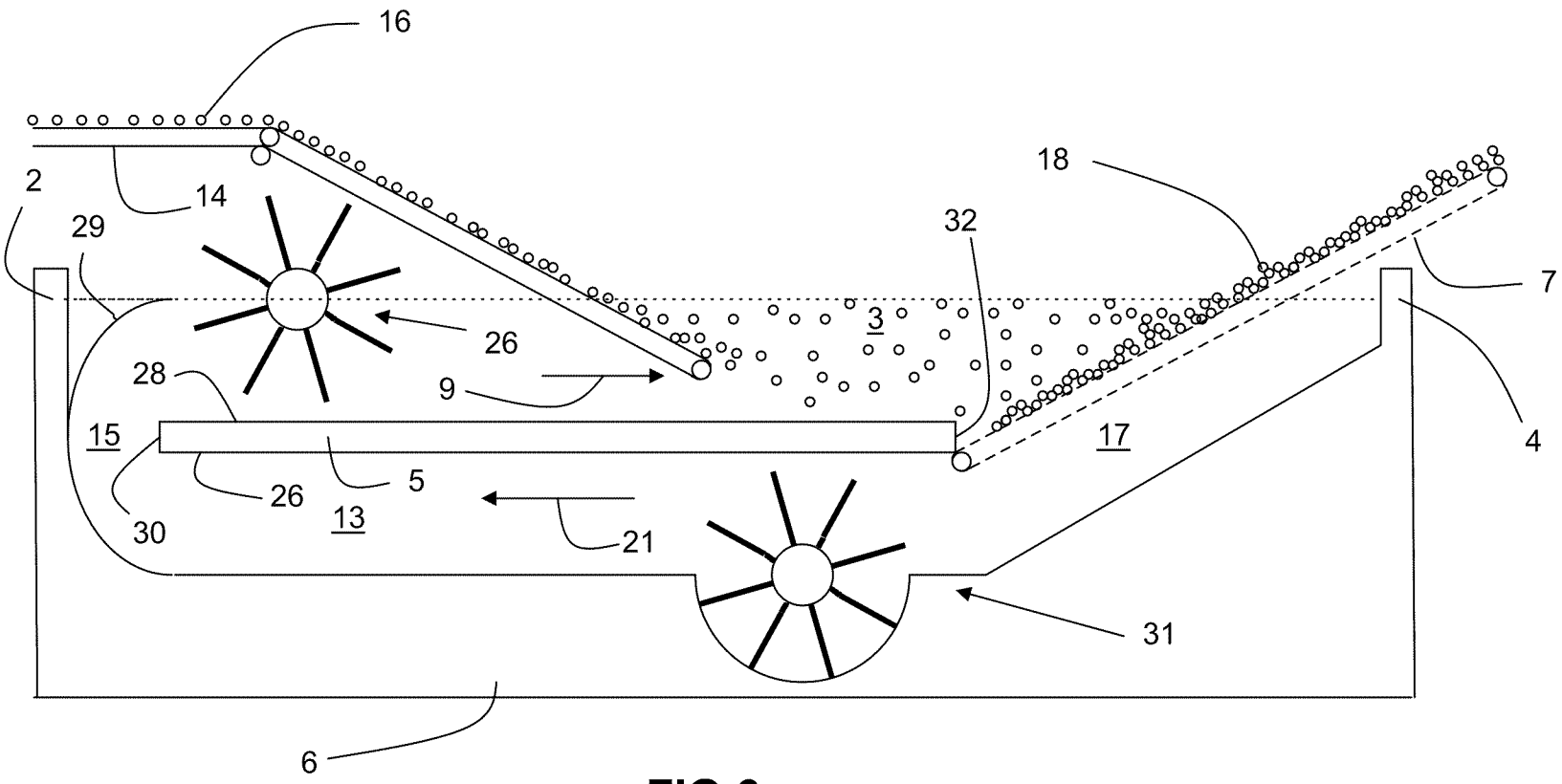
FIG. 6 is an elevation view schematic with parts broken away of a variation of the embodiment of FIG. 4.

As best shown in FIG. 6, an immersion bath according to another embodiment is similar to the one illustrated in FIG. 5 except that, instead of a metering device 11 to allow droplets of a liquid or semi-solid material to fall into the liquid nitrogen flow, a conveyor feed belt 14 feeds solid items 16 into the liquid nitrogen. While FIG. 6 shows a conveyor feed belt 14 that extends into and travels through the liquid nitrogen, it may instead extend only to a point over the surface of the liquid nitrogen. In this alternative case, the solid items 16 fall off the edge of the conveyor feed belt 14 as it reverses direction at the terminal roller. Through appropriate adjustment of the height of the conveyor feed belt 14 above the liquid nitrogen, the solid items 16 gently fall into the liquid nitrogen flow. The wholly or partially frozen items 18 are collected by the porous conveyor discharge belt 7 while the liquid nitrogen flows through and into the gap 17.

Figure 7:
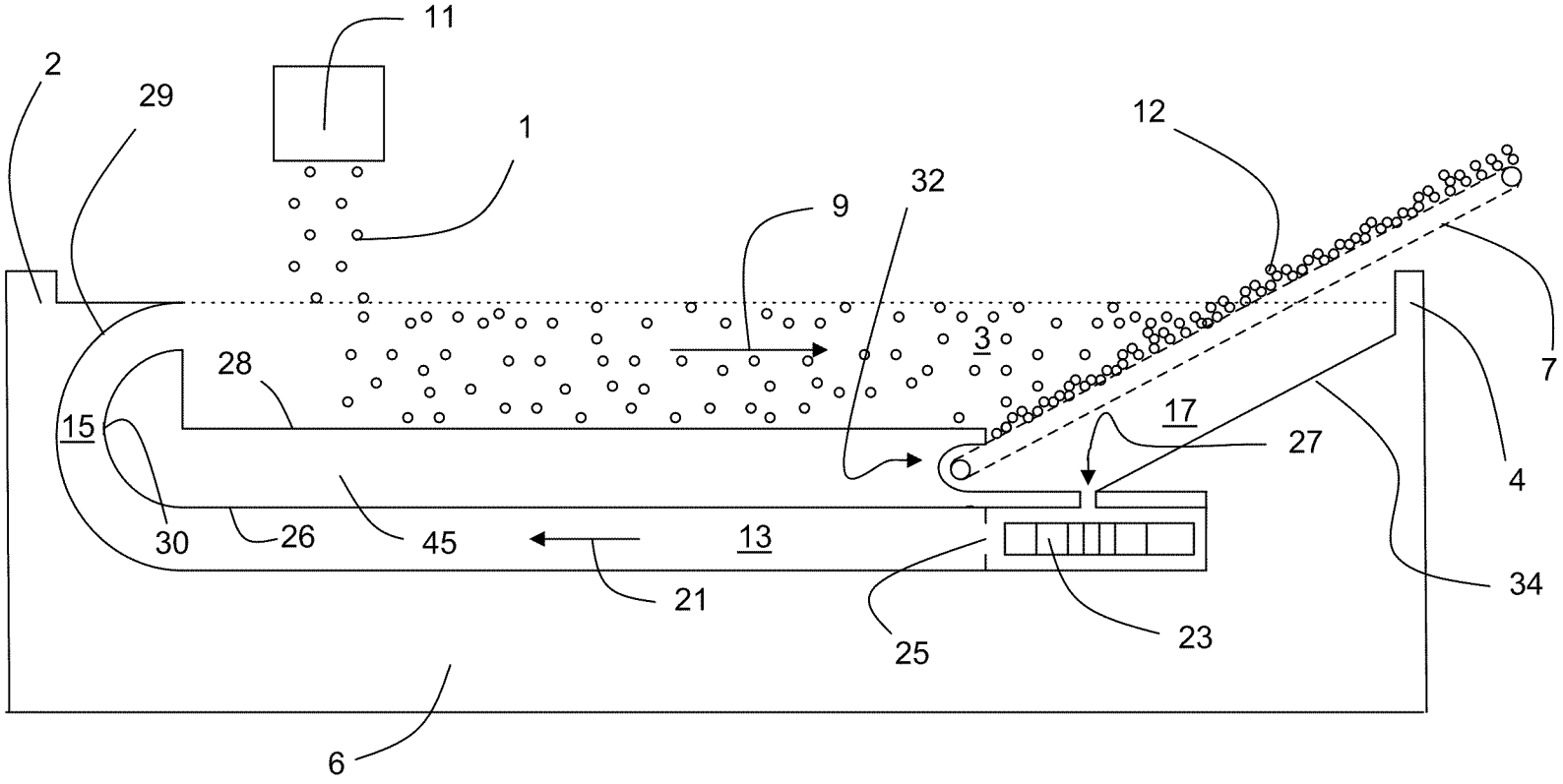
FIG. 7 is an elevation view schematic with parts broken away of another embodiment of the invention illustrating pelletization.

As best illustrated in FIG. 7, an immersion bath according to another embodiment is similar to that of FIGS. 3A and 3B with some notable differences. Instead of a pump 23 disposed underneath lower surface 26 adjacent upstream end 30, the pump 23 is disposed under gap 17 adjacent the downstream end 32 of baffle 5 where the downstream end 32 is concavely shaped so as to receive a terminal end of the porous conveyor discharge belt 7. An inlet 27 of the pump 23 is formed between an end of drip pan 34 and a lateral extension of downstream end 32. The upstream end 30 of the baffle 5 is convexly shaped roughly parallel to surface 29. The convex shape of the upstream end 30 curves up and around and then steps down towards the upper surface 28.

Figure 8:
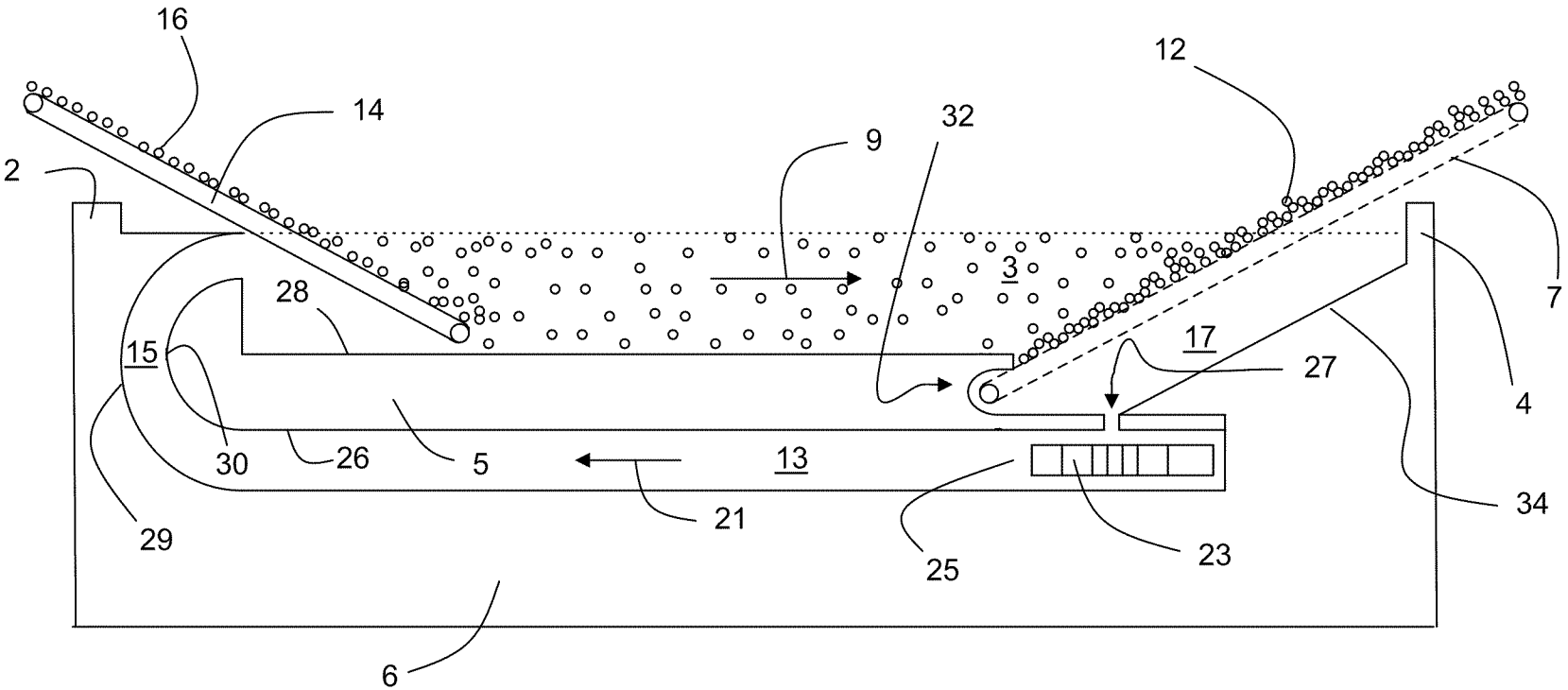
FIG. 8 is an elevation view schematic with parts broken away of another embodiment of the illustrating freezing of solid items.

As best illustrated in FIG. 8, an immersion bath according to another embodiment is similar to that of FIG. 4 with some notable differences. Instead of a pump 23 disposed underneath lower surface 26 adjacent upstream end 30, the pump 23 is disposed under gap 17 adjacent the downstream end 32 of baffle 5 where the downstream end 32 is concavely shaped so as to receive a terminal end of the porous conveyor discharge belt 7. An inlet 27 of the pump 23 is formed between an end of drip pan 34 and a lateral extension of downstream end 32. The upstream end 30 of the baffle 5 is convexly shaped roughly parallel to surface 29. The convex shape of the upstream end 30 curves up and around and then steps down towards the upper surface 28.

It should be understood that, while the FIGS illustrate certain lengths in between the feed point and the discharge belt, these lengths may be increased or decreased as desired to increase or decrease a residence time or the amount of volume of liquid nitrogen needed. Also, the residence time may be varied by varying the velocity of the liquid nitrogen flow with the pump and/or by varying the speed of the porous conveyor discharge belt. One of ordinary skill in the art will recognize that as the velocity is lowered, the material to be frozen will stay immersed in the liquid nitrogen a longer time because it will take a longer period of time to travel to the discharge belt.

Such a one will further recognize that slowing down the speed of the discharge belt will tend to create a damming effect whereby the density of the wholly or partially frozen material in the liquid nitrogen just upstream of the discharge belt is relatively high.

The invention exhibits several advantages over known cryogenic devices.

With regard to the problem of belt slinging caused by known immersion freezers, because the product is transported by the use of a controlled flow of liquid nitrogen, the freezing process is often largely completed before the product reaches the inclined discharge belt. The discharge belt, which (depending on product) may be cleated, will allow for frozen product to accumulate on the discharge belt at a depth and loading density higher than that in the liquid nitrogen flow. Therefore, the discharge belt can be operated at a slow enough speed to completely shed any residual liquid nitrogen in the form of drips back into the bath. Belt slinging can thus be virtually eliminated.

With regard to product deformation and belt sticking caused by known immersion freezers, because the invention relies upon a flow of liquid nitrogen convey the material to be frozen, product damage or sticking to the floor of the freezer can be avoided by having a sufficiently great depth of liquid nitrogen in the bath.

With regard to the limited production capacity of known pelletizers, because droplets are frozen by the inventive immersion bath in a horizontal flow of liquid nitrogen, the pelletizing capacity is only limited by the speed of the liquid nitrogen flow and ultimately the speed of the pump. Such a flow can be increased dramatically in the invention by increasing the pump speed without any adverse effects to the process. Thus, if more liquid or semi-solid product is dripped or injected into the liquid nitrogen, in order to avoid sticking of the droplets/pellets, one only has to increase the speed of the pump to create a droplet and pelletizer-free portion of liquid nitrogen for receipt of the next batch of falling droplets.

On the other hand, when the rate at which liquid or semi-solid material is dripped or injected by known pelletizers is increased, pellet-to-pellet sticking will tend to occur at a sufficiently high rate. In order to avoid this, the velocity of the liquid nitrogen in the sluiceways of known pelletizers can be increased by increasing the pump speed. However, increasing the pump speed will necessitate raising the height of the sides of the sluiceways in order to contain the increased height and turbulence of the liquid nitrogen flow. Otherwise, splashing of the liquid nitrogen over the sides of the sluiceways may occur. Such modifications are costly, complicated and time-consuming. This creates a serious limitation on the flexibility of known pelletizers to achieve a wide variety of production rates or residence times.

With regard to product jams and pump prime loss, the immersion bath of the invention has a relatively constant liquid nitrogen level that is easier to control. This is because there is essentially one level of liquid nitrogen across the entire bath surface in comparison to known pelletization systems having a depth of liquid nitrogen in sluiceways and a different depth of liquid nitrogen in a reservoir. No matter which liquid nitrogen flow rate is selected, the level of liquid nitrogen in the immersion bath of the invention will not change. In contrast, increasing the pump speed of a known pelletizer can dramatically change the level of liquid nitrogen in the reservoir.

Known pelletizers elevate the liquid nitrogen with a pump to the head of a sluiceway which either is itself a declining sluiceway or is a horizontal sluiceway that feeds a subsequent declining chute downstream of the discharge belt. The flow along the declining sluiceway or chute is caused by gravity. Because one or more sluiceways or chutes are declined, the height between the reservoir and "headwaters" of the initial sluiceway can be substantial. By selecting a suitable declination angle and sluiceway length, known pelletizers can achieve a desired flow rate for the liquid nitrogen. On the other hand, because the invention essentially utilizes an immersion bath with internal recirculation and an inertial liquid nitrogen flow (not a gravity-based flow), it does not need to reach the relatively high liquid heights needed by known pelletizer pumps. As a result, the pump of the invention consumes far less energy. Also, because known pelletizers utilize air-exposed sluiceways or chutes, the sluiceways and chutes act as heat sinks to warm the liquid nitrogen thereby losing overall cooling capacity. On the other hand, the immersion bath of the invention does not require lengthy sluiceways exposed to air, and as a result, the heat sink effect experienced by the known pelletizers is greatly reduced.

Preferred processes and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

What is claimed is:

1. A method of freezing a product in a recirculating liquid nitrogen immersion bath contained within a container, wherein the container comprises:

first, second, third and fourth walls extending upwardly from a floor, the first and third walls defining upstream and downstream ends of the container, respectively, the container having a height, width, and length;

a horizontal baffle secured between the second and fourth walls, the baffle having upstream and downstream ends and upper and lower surfaces extending therebetween, the baffle having a length shorter than a length of the container and being disposed within the container at a position that leaves a gap between the upstream baffle and container ends, a gap between the downstream baffle and container ends, and a gap between the baffle lower surface and the container floor, a space defined by said first, second, third, and fourth walls and said floor being filled with a bath of liquid nitrogen to a level within the space to define a surface of the bath, the baffle being completely submerged below the surface of the bath;

a pump that is completely submerged below the surface of the bath, said method comprising the steps of:

maintaining a recirculating flow of the liquid nitrogen entirely within the bath using the pump, the flow following a flow path, in order, along the surface from the upstream end to the downstream end;

along a bottom portion of the space in between the floor and baffle from the downstream end to the upstream end; and back along the surface, all vertical portions of the return section totally enclosing the flow of liquid nitrogen;

feeding a material to be frozen to the horizontal treating section at a feed point;

allowing at least a portion of the fed material to be frozen by the liquid nitrogen of the bath; and withdrawing the at least partially frozen material from the horizontal treating section downstream of the feed point.

2. The method of claim 1, wherein:

the material to be frozen is a liquid or semi-solid; and the liquid or semi-solid material is fed to the horizontal treating section by allowing the liquid or semi-solid material to drip into or be injected into the horizontal treating section.

3. The method of claim 1, wherein the at least partially frozen material is withdrawn from the horizontal treating section with a porous discharge conveyor belt extending partially into the liquid nitrogen.

4. The method of claim 1, wherein a residence time within the liquid nitrogen of the material to be frozen is controlled by controlling a velocity of the liquid nitrogen flow via the pump.

5. The method of claim 1, wherein a residence time within the liquid nitrogen of the material to be frozen is controlled by controlling a speed of the discharge belt.

6. The method of claim 1, wherein a depth of the liquid nitrogen in the horizontal treating section is greater than a major dimension of the material to be frozen.

7. The method of claim 1, wherein a flow rate of the liquid nitrogen is increased when the rate at which the material to be frozen is fed to the horizontal treating section is increased.

8. The method of claim 1, wherein a flow rate of the liquid nitrogen is decreased when the rate at which the material to be frozen is fed to the horizontal treating section is decreased.

9. The method of claim 1, wherein the material to be frozen is a food item.

10. An immersion bath for recirculating a flow of liquid nitrogen, comprising: a container having first, second, third and fourth walls extending upwardly from a floor, the first and third walls defining upstream and downstream ends of the container, respectively, the container having a height, width, and length, the first, second, third, and fourth walls and the floor defining a space for being filled with the liquid nitrogen bath; a horizontal baffle secured to the second and fourth walls, the baffle having upstream and downstream ends and upper and lower surfaces extending therebetween, the baffle having a length shorter than a length of the container and being disposed within the container at a position that leaves a gap between the upstream baffle end and the upstream container end, a gap between the downstream baffle end and the downstream container end, and a gap between the baffle lower surface and the container floor, the container and space being adapted and configured to be filled with the bath of liquid nitrogen above the horizontal baffle to define a surface of the bath; and a pump disposed within the space under a level of the lower surface of the baffle, completely submerged within the below a surface of the liquid nitrogen bath, and being operationally associated with the container and baffle, the pump and the container being adapted to induce the recirculating flow of liquid nitrogen entirely within the bath, in order, over a top surface of the baffle in a first direction, through the gap between the downstream baffle end and the downstream container end, in between the floor and the lower surface of the baffle in a second direction opposite that of the first, and through the gap between the upstream baffle end and the upstream container end.

11. The immersion bath of claim 10, further comprising a material feeder operationally associated with the container and being adapted to feed liquid, semi-solid, or solid material to be frozen into the flow of liquid nitrogen at a feed point above the baffle upper surface.

12. The immersion bath of claim 11, wherein the material feeder is a drip tray.

13. The immersion bath of claim 11, wherein the material feeder is an injector.

14. The immersion bath of claim 10, further comprising a porous discharge conveyor belt operationally associated with the container extending downwardly into the gap between the downstream container and baffle ends to a point below and adjacent the baffle downstream end.

* * * * *